United States Patent [19]

Abduganiev et al.

[11] 4,380,143

[45] Apr. 19, 1983

[54] DEVICE FOR WITHDRAWING ROTOR OF SPINDLELESS SPINNING MACHINE TO INOPERATIVE POSITION

[76] Inventors: Abdurakhim Abduganiev, Chilanzar, kvartal 20, 33, kv. 7; Valentin N. Tikhonov, ulitsa Sh. Rustaveli, 55, kv. 28; Gennady N. Shlykov, Chilanzar, kvartal 19, 31, kv. 3; Vitaly I. Zhestkov, Chilanzar, kvartal 19, 26, kv. 41, all of Tashkent; Timur P. Krjuk, prospekt Mira, 90, kv. 11, Moscow; Viktor M. Mukhin, ulitsa Bogdana Khmelnitskogo, 69, korpus 2, kv. 31, Tashkent; Jury N. Tikhonov, ulitsa Mukimi, 1, kv. 62, Tashkent, all of U.S.S.R.

[21] Appl. No.: 197,996

[22] PCT Filed: Feb. 27, 1979

[86] PCT No.: PCT/SU79/00011

§ 371 Date: Oct. 27, 1980

§ 102(e) Date: Oct. 22, 1980

[87] PCT Pub. No.: WO80/01815

PCT Pub. Date: Sep. 4, 1980

[51] Int. Cl.[3] ..... D01H 7/22; D01H 1/12

[52] U.S. Cl. ..... 57/89; 57/88; 57/407

[58] Field of Search ..... 57/58.89–58.95, 57/88, 89, 406, 407

[56] References Cited

U.S. PATENT DOCUMENTS

| | | | |
|---|---|---|---|
| 3,375,649 | 4/1968 | Bures et al. | 57/89 X |
| 3,999,365 | 12/1976 | Suzuki | 57/88 |
| 4,070,814 | 1/1978 | Goldammer et al. | 57/89 |
| 4,112,659 | 9/1978 | Stahlecker et al. | 57/88 X |

*Primary Examiner*—John Petrakes

*Attorney, Agent, or Firm*—Steinberg & Raskin

[57] ABSTRACT

A device comprises a housing (1) which carries bearings (2) of a rotor (3), a cylindrical pivot (4) fixedly secured to the housing (1), a latch (7) attached to the housing (1) by a spring (6), and a brake shoe (11). In accordance with the invention a strap (10) to which at least one brake shoe (11) and said latch (7) are fixedly secured is installed for a reciprocating movement on the housing (1).

8 Claims, 4 Drawing Figures

DEVICE FOR WITHDRAWING ROTOR OF SPINDLELESS SPINNING MACHINE TO INOPERATIVE POSITION

TECHNICAL FIELD

The present invention relates to the field of textile engineering and more particularly to the construction of devices for withdrawing a rotor of a spindleless spinning machine to an inoperative position.

BACKGROUND ART

To date ensuring a convenient and rapid servicing of a rotor, when, for instance, repairing a broken yarn, continues to be an urgent problem which is kept in mind when spindleless spinning machines are designed. For this purpose on many of the spinning machines each spinning station is provided with a device for withdrawing the rotor to an inoperative position.

In particular, known in the art is a device for withdrawing the rotor of a spindleless spinning machine to an inoperative position (see Specification to the French Pat. No. 2,186,554, published on Feb. 15, 1974). This device comprises a housing which carries rotor bearings. A hinge pin and a latch are rigidly attached to the housing. Withdrawing the rotor to an inoperative position, when required, is accomplished by disengaging the latch from a stop of the machine framework and then turning the housing around the hinge pin. After the housing is withdrawn, the rotor disengages from the rotation drive and then gradually comes to a halt. After the rotor has come to a halt necessary operations are performed at the particular spinning station of a machine.

This construction is advantageous in that it ensures safety in the servicing and essentially excludes the possibility of an accidental disabling of the rotating rotor in the course of its withdrawal. These advantages are due to the fact that the housing also functions at the same time as a protective casing which reliably guards the rotating rotor. The single inconvenience in using this device lies in that servicing the spinning station can be begun only after the inertial rotation of the rotor has terminated and this, certainly, takes time.

Known in the art is a device for withdrawing a rotor of a spindleless spinning machine to an inoperative position (see Specification to Inventor's Certificate of the USSR No. 209,265), whose construction allows a shortening of the time required for the rotor to come to a halt.

This device comprises a housing which carries rotor bearings and to which a cylindrical pivot is rigidly secured. The device also includes a latch attached to the housing by a spring. To provide for stopping the rotor, a brake shoe interacting with the rotor after withdrawing the latter to an inoperative position is secured to the spinning machine framework.

However, when the housing with the rotating rotor (whose rotation speed may be as high as 90,000 revolutions per minute) is being withdrawn, the cylindrical pivot is subjected to a load caused by a gyroscopic effect. Besides, the rotor portion brought into the interaction with the brake shoe disposed on the framework cannot be guarded with a case and hence there exists a possibility of injuries of the attending personnel in starting the machine and repairing a broken yarn.

DISCLOSURE OF THE INVENTION

The object of the invention is to provide a device for withdrawing the rotor of a spindleless spinning machine to an inoperative position whose brake construction enables bringing the rotor to a halt without withdrawing it to an inoperative position.

This object is attained by that in a device for withdrawing a rotor of a spindleless spinning machine to an inoperative position, comprising a housing which carries rotor bearings, a cylindrical pivot rigidly secured to the housing, a latch attached to the housing by a spring, and a brake shoe, according to the invention, a strap or slide member to which at least one brake shoe and said latch are fixedly secured is installed for a reciprocating movement on the housing. Such a constructional arrangement of the device enables the stopping the rotor to be initially commenced at the time when the latch is being disengaged from a stop of the machine framework. Thus, shifting to an inoperative position is carried out when the rotor is stopped which excludes the action of a load caused by a gyroscopic effect on the cylindrical pivot and eliminates the possibility of injuries. In addition, the time spent for servicing the rotor in the event of yarn breakage is shortened, thus contributing to an improvement in the productivity of the machine.

The housing is preferably formed with a guide to receive the slide member. This precludes the possibility of an accidental interaction between the brake shoe and the rotor caused by vibration, and facilitates operating the device during withdrawal of the rotor to its inoperative position.

The construction of the device is very compact and convenient in service when the latch is fixedly secured to the end face of the strap.

It is preferable that two brake shoes be secured to the strap at both sides of the rotor bearings, and that the latch have a limiting stop in the form of a step. Such a modification of the device allows shortening the time spent for stopping the rotor owing to a double action thereon: first by one brake shoe when the strap is shifted, and finally by the other brake shoe when the device housing is withdrawn. This significantly increases efficiency of rotor braking thereby increasing the productivity of the machine as a whole.

The brake shoe disposed at the latch side is preferably of a resilient material. This leads to an increase in the reliability of braking and shortens the rotor stopping time owing to a larger area of friction contact between the resilient brake shoe and the rotor. In addition, the use of a resilient brake shoe enhances the durability of the device due to a reduction in the radial loads on the bearings, as well as reduces liberation of heat in braking the rotor.

BEST MODE FOR CARRYING OUT THE INVENTION

Figure 1:
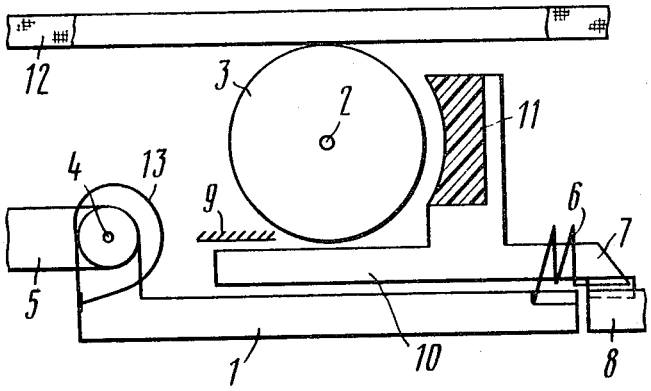
FIG. 1 shows a device for withdrawing a rotor of a spindleless spinning machine to an inoperative position, according to the invention.

Referring to FIG. 1, a device for withdrawing a rotor of a spindleless spinning machine to an inoperative position according to the present invention comprises a housing 1 which carries bearings 2 of a rotor 3. A cylindrical pivot 4 which couples the housing 1 to a machine framework 5 is secured to the housing 1. A latch 7 is attached to the housing 1 by a spring 6. In operating position, the latch 7 is engaged with a stop 8 of the framework 5. The housing 1 is provided with a guide 9 wherein a slide member 10 is mounted for a reciprocating movement. At least one brake shoe 11 is rigidly secured to the strap 10. The latch 7 is rigidly secured to the end face of the slide member 10. For the purpose of better understanding, a belt 12 which imparts rotation to the rotor 3 is shown in this figure as well as in the other Figures of the accompanying drawings. The housing 1 is linked with the framework 5 by a forced turn spring 13.

Figure 2:
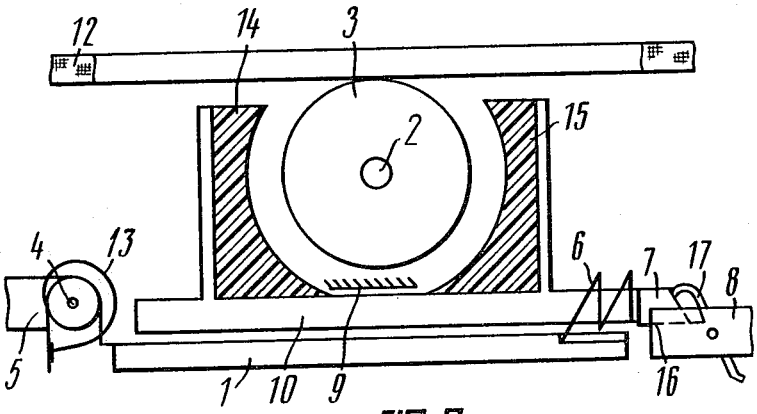
FIG. 2 shows a modification of the device according to the invention, comprising two brake shoes, with the rotor in operating position.
Figure 3:
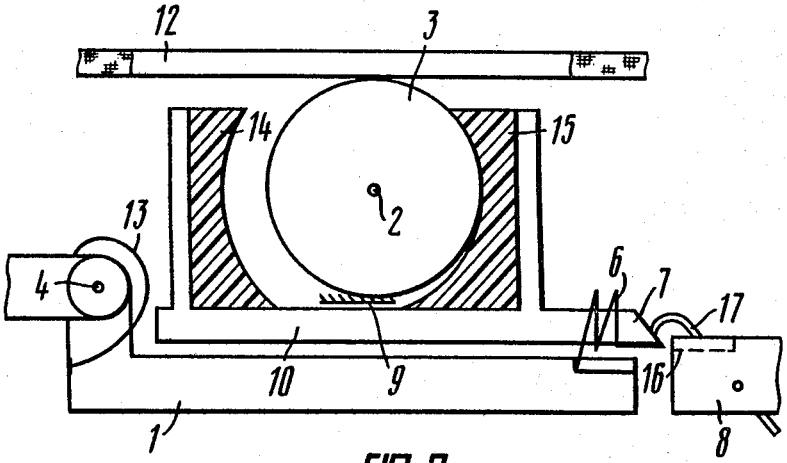
FIG. 3 illustrates the embodiment shown in FIG. 2, but at the moment of disengaging the latch from a stop of the machine framework.
Figure 4:
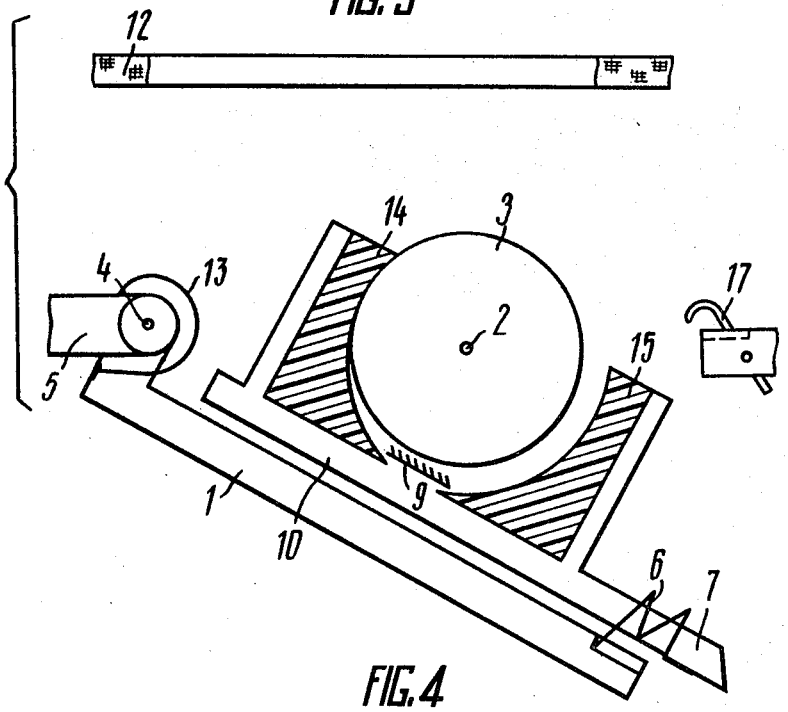
FIG. 4 illustrates the embodiment shown in FIGS. 2, 3, but at the moment of turning the rotor to the inoperative position.

The most preferable embodiment is the modification of the device, shown in FIG. 2 of the accompanying drawings, wherein two brake shoes 14 and 15 are secured to the slide member 10 at both sides of the bearings 2 of the rotor 3. The latch 7 has a limiting stop in the form of a step 16 which interacts with the stop 8 of the framework 5. The brake shoe 15 disposed at the side of the latch 7 is made of a resilient material, such as polyurethane. The other brake shoe 14 is of a stiff material, such as textolite. A turnable pressing member 17 is hinged to the stop 8 of the framework 5. The brake shoes 14 and 15 are secured at such a distance from each other and from the rotor 3 that they can alternately come into interaction with the rotor within the travel of the slide member 10, as is clearly seen from FIGS. 3 and 4 of the accompanying drawings.

The above-described device operates as follows.

To shift the rotor 3 to its inoperative position, the latch 7 is disengaged from the stop 8 of the framework 5; the translatory movement is transmitted to the slide member 10, and the brake shoe 11 comes into contact with the rotor 3 and stops it. To stop the rotor 3 more rapidly, one should press on the latch 7 and, holding the housing 1, slightly turn the latter to withdraw thereby the rotor 3 from the belt 12. After the rotor 3 has come to a complete halt the housing 1 is released and turns under the action of the spring 13 to shift the rotor 3 to inoperative position.

The modification of the device, shown in FIG. 2 of the accompanying drawings, functions as follows. To shift the rotor 3 to its inoperative position, one turns the pressing member 17 which disengages the latch 7 from the stop 8 of the framework 5; the slide member 10 moves together with the latch 7, and the spring 6 is compressed. The resilient material brake shoe 15 comes into contact with the rotating rotor 3 and starts braking the latter, as will be seen from FIG. 3 of the accompanying drawings. As the latch 7 and the slide member 10 move further, the resilient material of the brake shoe gets deformed and continues exerting an ever increasing braking effect upon the rotor 3. After the latch 7 is completely disengaged from the stop 8 of the framework 5, the spring 13 turns the housing 1 to the inoperative position shown in FIG. 4 of the accompanying drawings. During the turn, the slide member 10 moves under the action of the spring 6 so that the stiff brake shoe 14 comes into contact with the rotor 3, which shoe completely stops the rotor 3.

INDUSTRIAL APPLICABILITY

The present invention may be employed in the textile industry on spindleless spinning machines which produce yarn from natural and man-made fibres and have a rotating rotor or cup as the forming and twisting members.

We claim:

1. Apparatus for withdrawing a rotor of a spindleless spinning machine to an inoperative position and for braking the rotation of the rotor, comprising:
   - a housing in which a rotor is mounted and bearings for rotation about an axis of rotation;
   - cylindrical pivot means for pivotally mounting said housing to a framework of the spinning machine such that said housing is pivotable about an axis which is substantially parallel to the axis of rotation of said rotor between a first position wherein said rotor mounted in said housing is in an operative position and a second position wherein said rotor is in an inoperative position; and
   - a slide member mounted on said housing for translatory reciprocating movement thereon in a direction substantially normal to the axis of rotation of said rotor, said slide member having at least one brake shoe secured thereto adapted to selectively interact with said rotor at a point within the sliding travel of said slide member on said housing, and latch means provided on said slide member adapted to releasably engage the framework of the spinning machine when said housing is in said first position;
   - whereby in order to withdraw said rotor to the inoperative position and brake its rotation, said latch is slidably moved to a position such that it is disengaged from the framework of the spinning machine, such movement being transmitted to said slide member which translates on said housing whereupon said brake shoe comes into contact with said rotor to terminate its rotation.

2. The combination of claim 1 wherein said latch member is coupled to said housing by spring means.

3. The combination of claim 1 wherein said housing is formed with guide means for receiving said slide member.

4. The combination of claim 1 wherein said latch means are secured at an end of said housing.

5. The combination of claim 1 wherein two brake shoes are secured to said slide member, each brake shoe being situated on a respective side of said rotor.

6. The combination of claim 5 wherein said latch member is coupled to said housing by spring means and wherein when said latch is slidably moved to a position such that it is disengaged from the machine framework, said slide member translates in one direction on said housing against the force of said spring means whereupon one of said brake shoes comes into contact with said rotor, whereupon said housing pivots towards said second position whereupon said slide member translates in the opposite direction under the force of said spring means whereupon the other one of said brake shoes comes into contact with said rotor.

7. The combination of claim 5 wherein one of said brake shoes is situated between said rotor and said latch means and is formed of a resilient material.

8. The combination of claim 1 wherein said latch means includes a limit stop in the form of a step.

* * * * *